United States Patent [19]

Murga

[11] Patent Number: 4,845,629

[45] Date of Patent: Jul. 4, 1989

[54] AIRPORT SURVEILLANCE SYSTEMS

[75] Inventor: Maria V. Z. Murga, Madrid, Spain

[73] Assignee: General de Investigacion Y Desarrollo S.A., Madrid, Spain

[21] Appl. No.: 887,609

[22] Filed: Jul. 17, 1986

[30] Foreign Application Priority Data

Jul. 18, 1985 [ES] Spain ..... 545.350
Dec. 31, 1985 [ES] Spain ..... 550.603

[51] Int. Cl.[4] ..... A62C 37/04

[52] U.S. Cl. ..... 364/439; 169/61; 364/449

[58] Field of Search ..... 364/439; 342/37; 169/23, 46, 62, 16, 47; 239/587

[56] References Cited

U.S. PATENT DOCUMENTS

| | | | |
|---|---|---|---|
| 3,583,637 | 6/1971 | Miscorich | 239/203 |
| 4,179,695 | 12/1979 | Levine et al. | 343/6.5 R |
| 4,181,179 | 1/1980 | Batte | 169/47 |
| 4,319,243 | 3/1982 | Vachenauer et al. | 343/6.5 R |
| 4,418,349 | 11/1983 | Höfgen et al. | 343/6.5 R |
| 4,607,702 | 8/1986 | Miller | 169/25 |

*Primary Examiner*—Parshotam S. Lall
*Assistant Examiner*—Thomas G. Black
*Attorney, Agent, or Firm*—Ladas & Parry

[57] ABSTRACT

An automatic system for surveillance, guidance and fire fighting in airports. The system is arranged to monitor the position of aircraft in the taxiways, parking areas and flight lanes and in the event of an accident in the flight lane to extinguish any fires caused thereby. Infrared sensors are arranged along the flight lanes and their output signals are processed by a computer to provide information concerning the aircraft movements along the flight lanes. In the event of an emergency the computer processes the output signals from the sensors to determine the precise location and area of any heat sources in the flight lane and causes hydrants to direct fire-extinguishing fluid at the heat sources. Position detectors are provided for detecting the position of aircraft in the taxiways and parking areas. The output signals from the position detectors are processed by a computer to determine the position of the aircraft and the output of the computer is arranged successively to illuminate beacons to guide the aircraft along a selected route.

23 Claims, 13 Drawing Sheets

AIRPORT SURVEILLANCE SYSTEMS

BACKGROUND OF THE INVENTION

The present invention relates to an automatic surveillance, guidance and fire-fighting system or installation, and concerns a system or installation whose primary purpose is to prevent accidents and, in the event that they do occur due for example to aircraft fault or pilot error, to bring about the extinction of any fires which occur, in the shortest possible time, by means of the functional integration of surface telemetry and automated fire-fighting.

In the same way that other airport systems were designed and implemented in their time (such as VASIS, ILS, CALVERT, etc.), all of which satisfactorily met the established requirements for achieving air safety, so also the present, newly designed system (RUSTEM), meets other requirements in the same field, but within the airport precincts.

In order to explain what the system comprises as well as the grounds which justify it, it is useful to set out the current state of affairs and accordingly introduce the necessary conceptual innovation in specific important aspects, being those which epitomize the characteristics of RUSTEM ("Runway Security and Taxiway Escort System").

In effect, wherever there is an aircraft in operation, the concept of air safety and the necessary means of attaining this must be present, whether the aircraft is in the air or on the ground Thus the concept of air safety covers the whole range of air-air, air-ground, ground-ground and ground-air circumstances.

Likewise, if this approach is not taken, a gap in safety will occur in this relationship which may result in an accident, whilst the aircraft is in operation in any of the four circumstances mentioned above, transporting people, goods and fuel.

It is well-known in the air industry that from time to time serious accidents occur, although their prevention, and where necessary fire-fighting operations, have been a priority effort of the aeronautical profession. The present system is part of this effort, though in this instance it is related to the airport environment, that is the ground-ground situation.

In this context it is appropriate to recall the accident which occurred in 1983 at the airport of Barajas (Madrid), in which two aircraft collided on the ground. On this occasion, one aircraft was on its take-off run, whilst the other aircraft in taxiing and trying to head for the start of the runway to take-off in its turn, took a wrong turning and moving across a fast exit slipped into the middle of the flight path, where the collision occurred.

At this time the airport was not under minimums, but visibility was poor so that the aircraft which was taking off did not see the intruding aircraft, neither did the latter see the aircraft taking off, nor did the tower at that time see either of the aircraft, all due to the length of the runways This occurs in certain circumstances where the airport is operative but there is not clear visibility over the full distances.

These situations, and many others, indicate conditions of a lack of air safety which require analysis and a complete solution of the problems to which they give rise.

Furthermore, an aircraft in flight is not close to the ground, whilst in take-offs, landings and taxiing, it is in contact with it and therefore is in a higher risk situation, in which safety conditions must be maximized.

Since it is possible to set up ground installations in airports which could not be set up throughout a country, and since aircraft must operate in airports, it is clearly desirable to provide a safety system on runways and taxiways capable of guaranteeing this safety. The RUSTEM system is intended to meet this requirement.

Also, the increase in modern air traffic, which leads at times to saturation in the number of operations per hour on an operative runway, has led to an increase in the risk of accidents, taking into account the poor visibility conditions which often occur. This expansion in traffic makes a built-in airport safety system increasingly urgent and necessary, as the accidents in different airports of the world confirm. The same problem occurs in military air bases, where there is the additional problem that combat aircraft may enter the base in emergency conditions, for which reason telemetric monitoring and automated fire-fighting thus become necessary. The RUSTEM system can be applied to both civil and military airport ground situations.

Two damaging effects occur in an accident: ruptures and fire.

In accidents en route, the most important factor is usually ruptures, whilst generally in airport accidents fire is the cause of the greatest damage.

This is due to the different velocity of the aircraft en route and in the airport, so that the dynamic impact is usually much greater in an accident in the air.

On the other hand, once an accident has taken place in an airport, it is obvious that there is not the least remedy in the case of ruptures, causing damage to the aircraft and the passengers. However, the fire factor develops according to a specific process, and, fire being the determining factor in causing the greatest damage in airport accidents, it may be combatted because it is a process, provided of course that there are the necessary means for this, both in extinguishing capacity and in speed of activation, since without the latter condition the fire itself will put paid to the matter From what has been said it emerges that the sole means of combatting the rupture factor is by avoiding the accident, as far as possible in the airport, within the present margin of possible aircraft faults or pilot error, for which reason prevention in this case lies in the area of telemetric monitoring, guidance and signalling on the ground. If, despite the measures taken, an accident occurs due to the aircraft or the pilot, the airport infrastructure must then have available an automatic fire-fighting system for eliminating fires extremely rapidly, since fire is generally the most damaging factor in airport accidents.

The research carried cut in the quest for an efficient airport system which will meet these requirements, emphasized the necessity for integrating the surveillance and fire-fighting functions into one single system.

In fact, given the great speed required in fire-fighting, this had to be of an automatic nature. Since an aircraft which has had an accident may become immobilized (or its hot sections) at any point of the surface in question, it was obviously necessary to have available the x,y coordinates of the aircraft or its sections. Hence it was necessary to integrate telemetric surveillance with automated fire-fighting. Furthermore, if surface telemetry provides the x, y position of a damaged aircraft, or of its sections in the case of it being ruptured, this surface telemetry could also be used to obtain the position of normal aircraft, that is not in a state of emergency, in normal operation.

With this, the conclusion was reached that a telemetric method had to be used in our system, both for the monitoring of normal aircraft and for establishing emergencies according to the various forms and circumstances in which these could occur in each instance, as for example fuel which has leaked and is on fire. As aforementioned, the fire-fighting method has to be automatic due to the great speed demanded, since it is not just dealing with a simple fire, but with an aircraft carrying people, and loaded with highly inflammable fuel. Hence the designer's thinking has to be governed by the time-scale, taking the second as the unit.

Nevertheless, it is essential to point out that, regarding air traffic, two very different areas or environments must be considered in airports: on the one hand the flight strips (which contain the flight runways, one runway for each strip), and on the other hand the taxiways in their entirety, and the aircraft parking areas.

The vast majority of airport accidents occur in the first mentioned area, where aircraft are running at great speed. In the second area, in the taxiways, aircraft are travelling slowly in procession and able to brake quickly where necessary, as is the case in the parking areas.

This qualitative and quantitative distinction is taken into account in the present system, supplying the appropriate solution for the characteristics of each of the indicated environments.

As will be seen, the current situation is analysed and, as a result of the limitations of tanker trucks (as currently used in fire-fighting), as well as the limitations of surface radar (as used in surveillance in some airports), research into a new system which could completely solve these limitations, gave rise to the RUSTEM system, in which surveillance and fire-fighting are functionally integrated in a single operational system, constituting an innovation in the airport field.

SUMMARY OF THE INVENTION

In broad outline, which will be explained in greater detail in the following pages, and taking into account the fact that statistically airport accidents occur on the flight strips in the vast majority of cases, a RUSTEM system can include the following elements:

(a) Two parallel, buried lines of hydrants, one on each side of the runway. These lines, being a fixed system, extend beyond both thresholds at the heads of the runways. The hydrants only emerge in case of accidents, and have elevation, rotation and to-and-fro movement. So that when their valve is triggered they can take care of any accident occurring within the flight strip as rapidly as possible The automatic action of the hydrants is computer-controlled. The pipes feeding them are kept filled constantly. Thus, activation of the system from the airport tower leads to their entry into operation in a matter of a few seconds.

(b) As far as surveillance is concerned, there are two different zones as described earlier. The main surveillance is over the flight strips with additional surveillance over the taxiways and parking areas, by means of aircraft control and guidance.

(b.1) Two parallel lines of infra-red, telemetric sensors are installed along the flight strips, capable not only of tracking the trajectory of the aircraft, but also of detecting heat sources in case of emergency, feeding this data to the automatic fire-fighting operations. Similarly, several anemometers obtain wind data. The whole flight strip is in the form of a rectangle, and the aforementioned telemetric sensors are located along the longest sides of this rectangle, monitoring the strip.

(b.2) In the taxiways and parking areas the interest is in the aircraft control and guidance system, according to OACI SMGC requirements, simultaneously maintaining and monitoring minimum separation between aircraft. Thus continuous detectors are installed, as well as directional beacons along the axis, and, where necessary, directional beacons along the edges, and some airport traffic lights. Both the detectors and traffic lights are interconnected with a computer which processes taxiing and parking throughout the airport.

(b.3) Aircraft movements in the taxiways and parking areas are automatically guided, each aircraft having in front of it a specific number of lit axial beacons, according to the aircraft's route. The number of beacons is always fixed, about 100 meters apart. Thus, as the aircraft moves forward it is detected by the taxiing beacons, which send signals to the computer, and the latter lights up new axial beacons in front of the aircraft according to the route it has to take, and switches off the beacons which the aircraft has left behind. The computer establishes rights of way at crossroads, where the aircraft which has to wait will see its axial beacons flashing on and off and the crossroad traffic light on red. Once the first aircraft having right of way has passed across the crossroad, the second aircraft which had to wait will have its axial beacons lit continuously to enable it to continue on its way. Any intermittence in the guidance beacons signals the pilot to brake.

The aforementioned taxiing detectors are neutral and without electrical current throughout the airport, with the exception of those corresponding to the sensing of each aircraft. These detectors only pick up the aircraft, but purposely do not pick up other objects such as service vehicles or people. Hence cars or people, purposely not being picked up, do not distort the detection signals which correspond only to aircraft, and therefore the computer continuously guides each aircraft from an initial point to a final point, according to a route which has been laid out by the control tower. The activated detectors go on activating others in the direction of travel of the aircraft, picking it up and deactivating the previous detectors along the aircraft's taxiway.

(c) A set of elements is installed in the airport tower, which amongst others consist of the following:

(c.1) A main panel on which the runway computer displays the aircraft's reference both in its flight path and as it comes to a halt. In the event of an emergency, this computer on the one hand produces several alarms and on the other hand draws some emergency circles corresponding to a damaged aircraft, or its hot sections and fire sources. In the event of aircraft collision the same thing happens. Similarly, in the event that an intruding aircraft penetrates into the rectangular area of the air-strip, the alarm is automatically activated.

Likewise, the computer which controls taxiing also displays the position of the identification references corresponding to the aircraft situated in the taxiways and parking areas. In the event that an aircraft goes below its minimum distance on the taxiway with respect to the aircraft preceding it or takes a wrong route, an alarm is also provided, and at the same time the reference on the panel relating to the offending aircraft blinks intermittently.

(c.2) A control console from which the whole system is controlled, both for surveillance and guidance as well as for fire-fighting, with simple and extremely sparing operations for the controllers, since the system's data processor carries out the work.

Similarly, the taxiway traffic lights are automatically activated, the internal routes for taxiing being indicated "in situ", and activated locally for each aircraft, according to whether it is on its landing run, or "en route" from the parking area to the runway and the head of its take-off exit; also indicated are the routes from the runway to the parking area, taking into account the corresponding runway head. In addition, routes from the parking area to the hangars and vice versa are shown; or from hangars to runway, and vice versa.

(c.3) Computers and automatic connections.

(d) Lastly, there is the installation of piping, for water and extinguishing substances, their storage tanks, pumps, dispensers, drums, autoprotection devices, connections, and other appropriate and necessary elements for the hydrant system. Also the general piping for the supply of the hydrants from one and the same line may be unique, the dispensing then being carried out at the start of the general piping. Also there is a power plant with electrical connection to the airport's supply network, and from this plant the various elements of the RUSTEM system are supplied. It is taken for granted that the whole airport has to have general emergency generating units. Furthermore, the system is adaptable to any civil airport or air base. And in the event that once installed it is decided to increase the length of a runway, the lines of hydrants and telemetric sensors of this flight lane can be extended, so that the previous installation remains operative and valid.

Statistically, 99% of airport accidents, including situations where aircraft have previously announced their emergency status, occur within flight lanes. Therefore it is both logical and necessary for automatic hydrants to be installed within the said lanes, hydrants which due to their range and their three degrees of freedom, are capable of covering any emergency, being able to act both in treating the whole runway, as well as on specific points on the damaged aircraft, colliding aircraft, or their dispersed sections, eliminating heat sources, acting globally and simultaneously on all of them.

The hydrants referred to are always without pressure and without electrical current. Thus, there is double protection against their being activated spontaneously. That is to say, if and only if, the tower activates the fire-fighting system, do the telemetric sensors along the flight lane send the position and extent of the heat sources to the computer, and the anemometers send the wind force and direction; with this data the computer system rapidly calculates the fire-fighting parameters, i.e. selects the specific hydrants which will be activated and supplies them with the operating parameters corresponding to each of them, and it is then that the selected hydrants enter into operation, in a very few seconds, launching a large discharge of extinguishing fluid and rapidly suppressing the heat sources.

While there is an aircraft in motion within the flight lane, whether in normal or emergency status, the system is locked and cannot operate. The fire-fighting operation only occurs with a motionless aircraft.

However, the hydrants can prepare the runway on the announcement of a damaged aircraft approaching the airport.

Lastly, it was evident that an installation in accordance with the invention allows the possibility that the analogue type signals originating from the surface radar installed in an airport may be processed by the computer equipment of the said installation and incorporated as an additional element with regard to airport safety. The surface radar would act as one more sensor for the installation, its signals being used as additional data for the overall safety system. To this end, the aforementioned installation can be improved in the following manner: (j) for airports operating in very low visibilities, some flight lane sensors, in addition to infra-red sensing, incorporate an emitter and detector of electromagnetic pulses, or an ultrasonic active element, capable of detecting objects within the flight lane relating to aircraft or vehicles; (k) for airports with normal or average visibility, the standard sensors not only pick up the aircraft located in the flight lane, but also vehicles penetrating it; (l) there is the option of installing an interface capable of processing the signals originating from the surface radar which has been installed in an airport, and introducing such signals into the computer controlling the surveillance, and with this data making an addition to the functions of the system; (m) there is the option that the installation's taxiing detectors may be generally activated simultaneously, and the sensing of aircraft and other objects may be carried out simultaneously, in this case means can be incorporated for discriminating aircraft from other objects, and maintaining the logical sequence in the guidance of each aircraft in the zone of movement and parking of aircraft; and (n) there is the option that the piping and pressure storage tanks for water and extinguishing agents for the flight lane are divided up into independent modules, and their discharge is attained by means of the pressure of a compressed gas connected by regulating valves to the water and extinguishing agent storage tanks.

Figure 1:
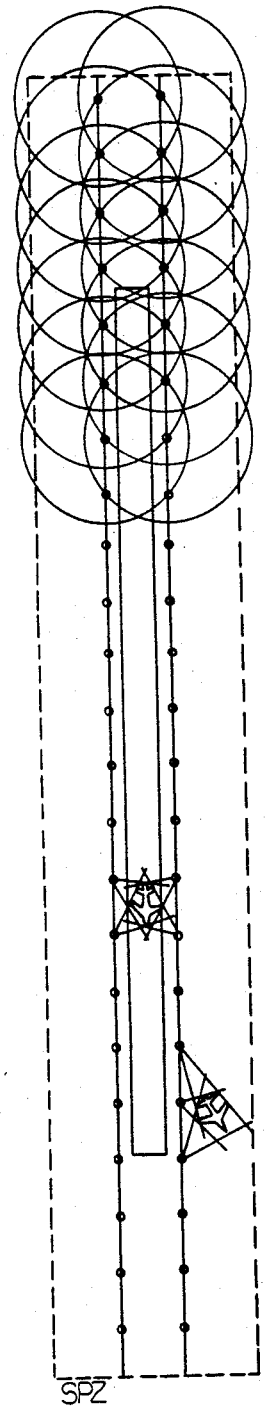
FIGS. 1 and 2
SPZ—Standard Protection Zone
FIG. 3*a* to *c*
Tr—Trap
La—Cannon jet
Ag—Rubber shock absorber
Tm—Elevating motor supply trolley
Ae—Extinguishing agent
Ag—Water
Mg—Mobile base turning motor
Ro—Bearings
Tg—Main cover
To—Trolley
En—Gear
Bf—Fixed base
Bm—Mobile base
Me—Elevating motor
Jr—Rotary joint
FIG. 5
P—Plan
El—Longitudinal axis
FIG. 7
ISA—Infra-red sensored area
SPZ—Standard protected zone
FIG. 9
ISA—Infra-red sensored area
FIG. 10
Figure 2:
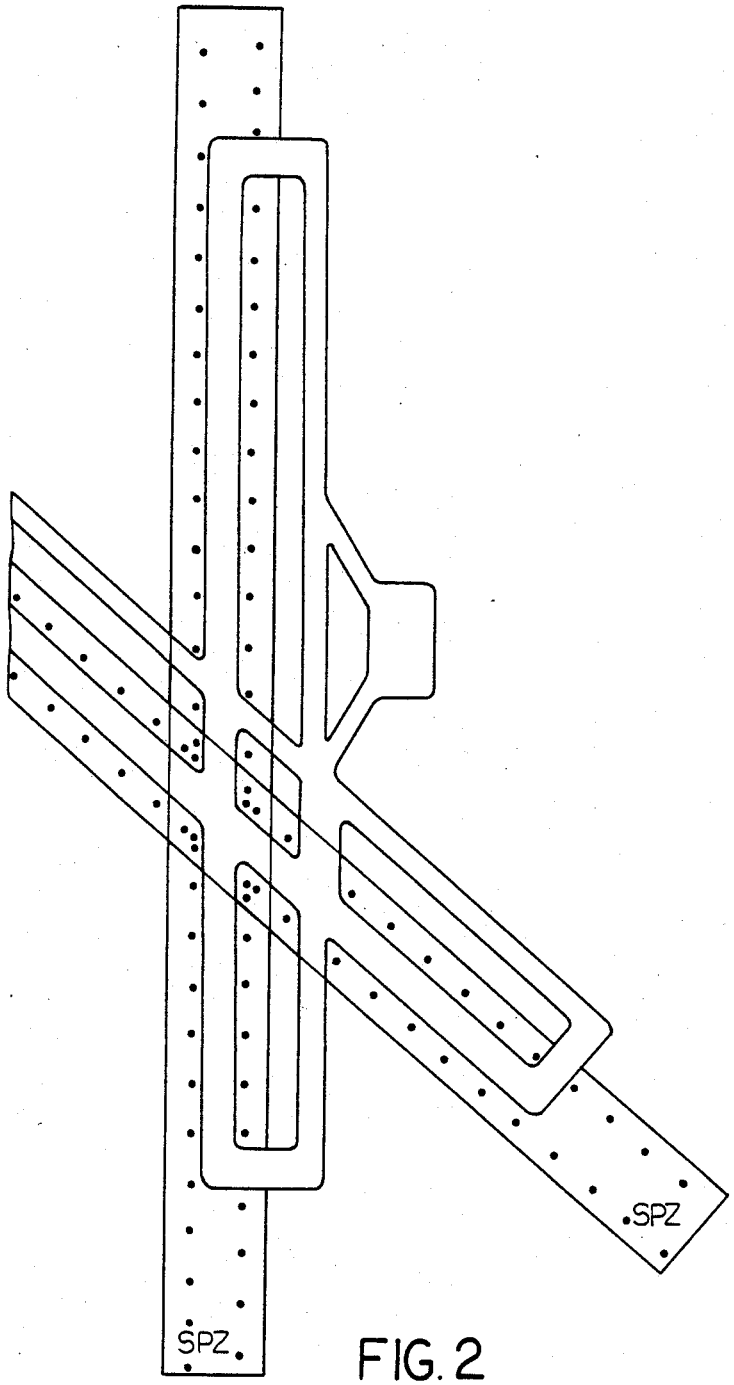
Figure 3B:
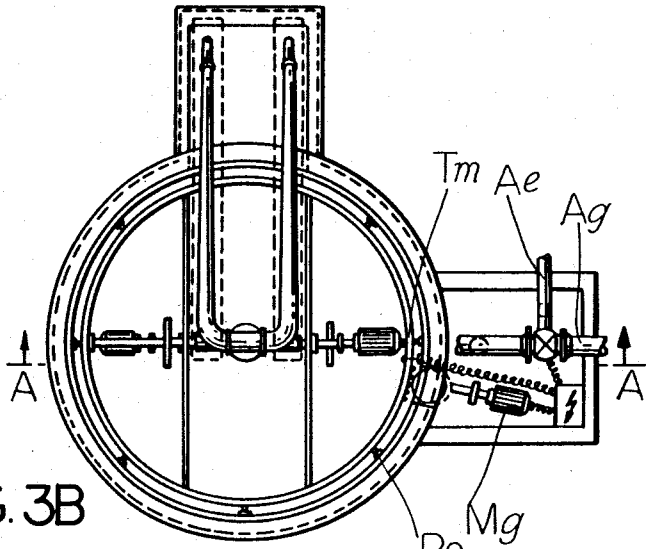
Figure 3A:
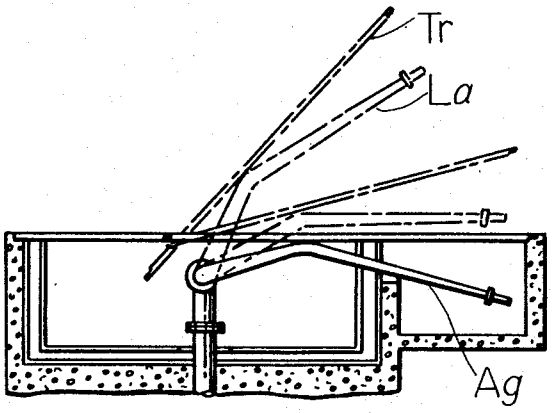
Figure 3C:
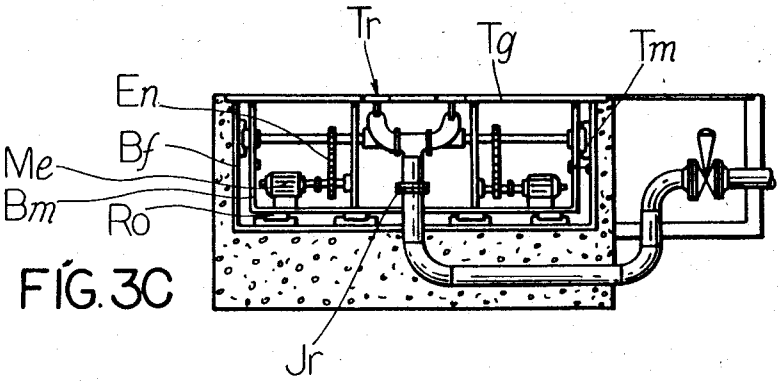
Figure 4:
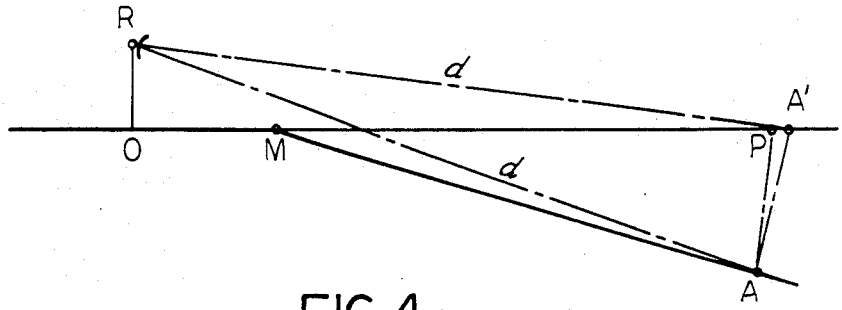
Figure 5:
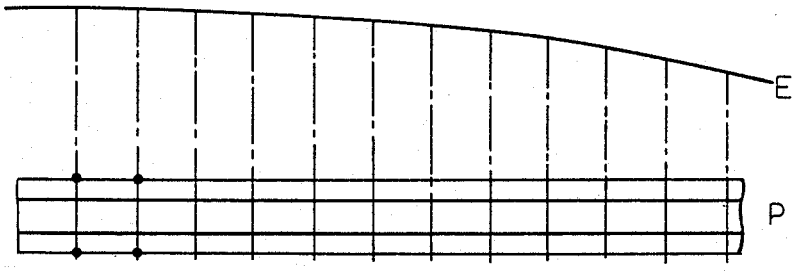
Figure 6:
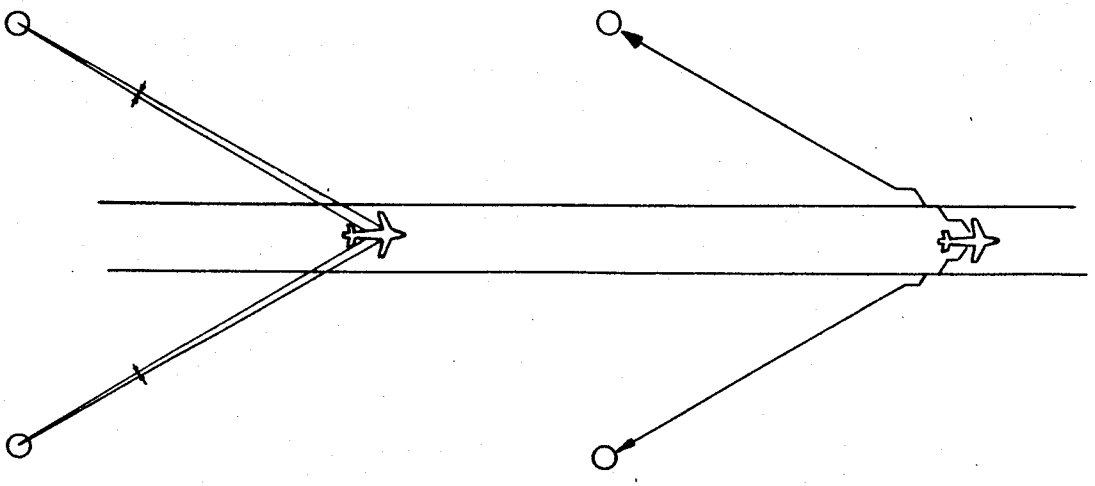
Figure 7:
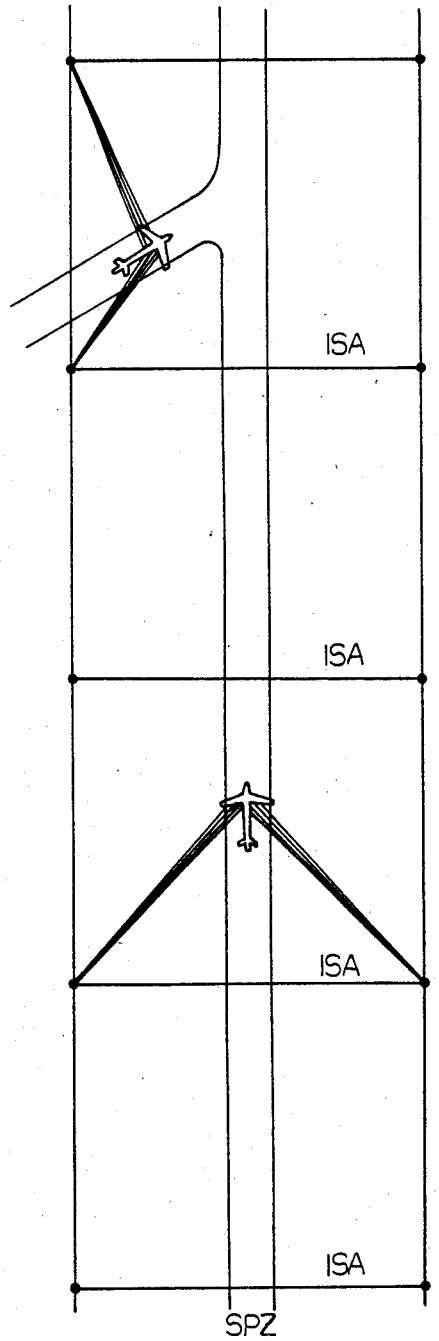
Figure 8:
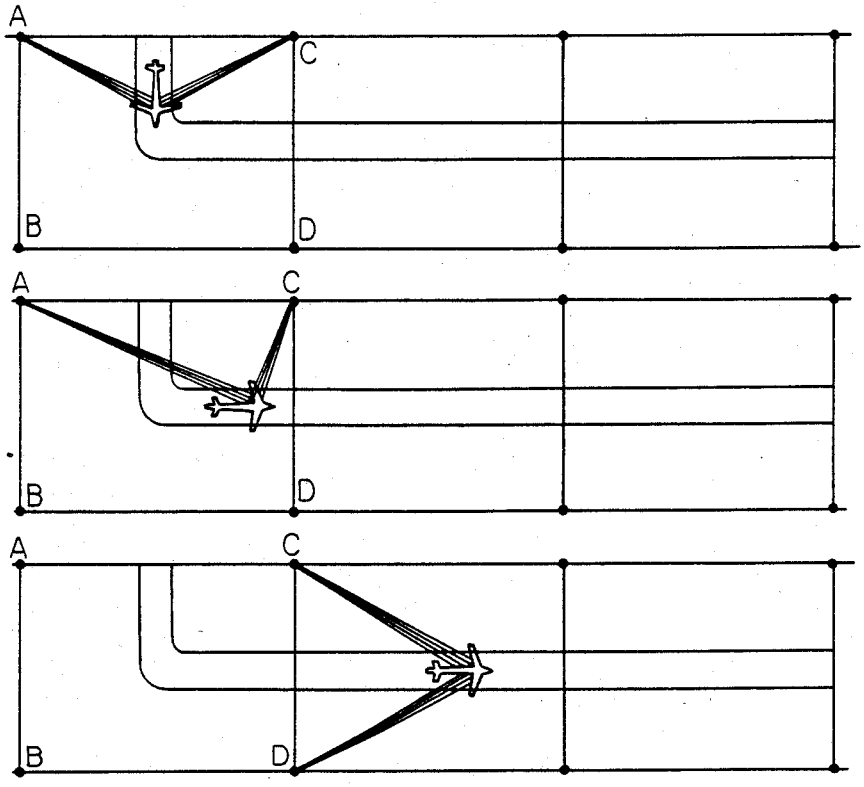
Figure 9:
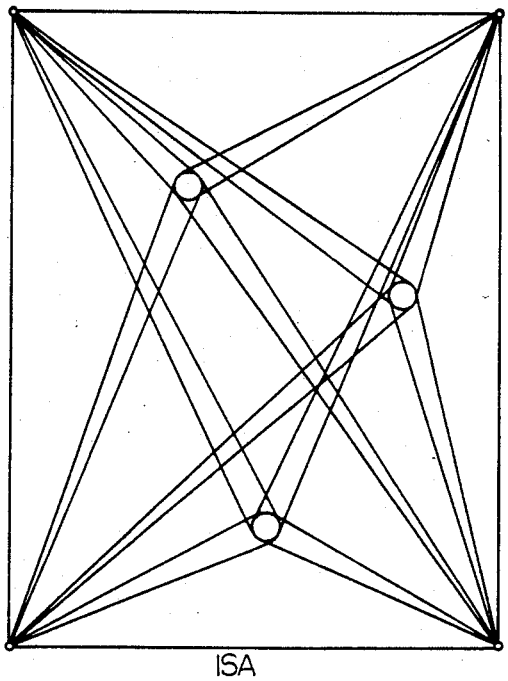
Figure 10:
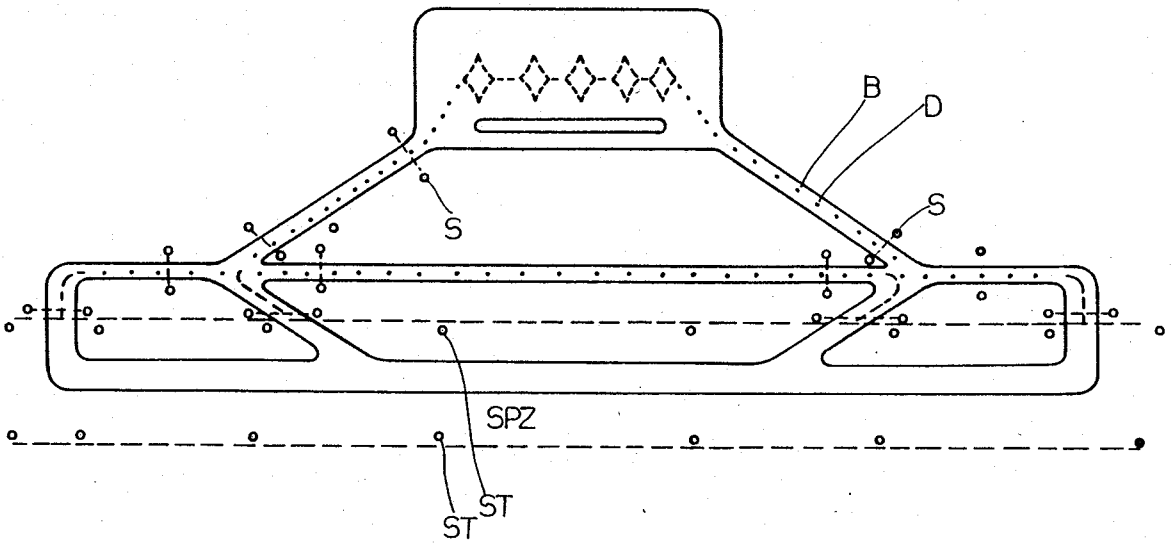
Figure 11:
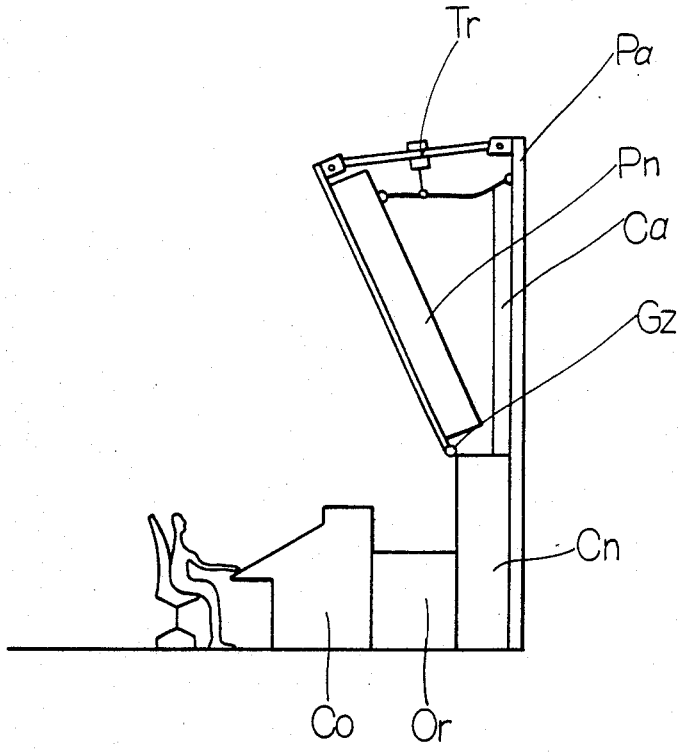
Figure 12:
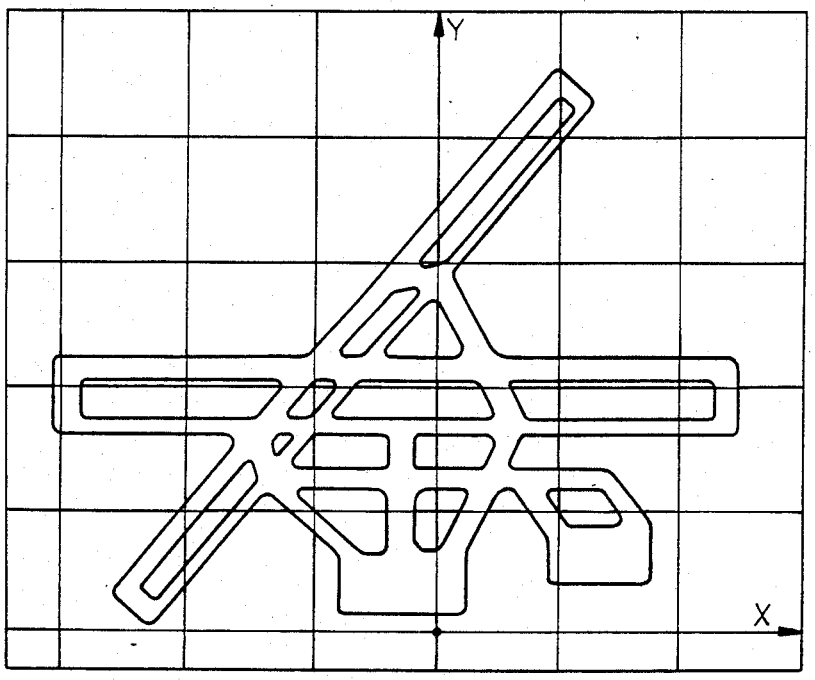

ST—Flight lane, taxiway and parking telemetric sensor
D—Detector
S—Traffic light
B—Guidance beacons
SPZ—Standard protected zone (flight lane)

FIG. 11

Tr—Adjustable support rod
Pa—Wall
Pn—Panel
Ca—Cable
Gz—Hinge
Cn—Connections
Co—Console
Or—Computers The invention will now be described by way of example with reference to the accompanying drawings, in which:

FIG. (1) is a representation of a "standard protected zone" (SPZ), i.e. a flight lane fitted with automated hydrants and telemetric sensors for surveillance, able to be integrated with automatic free-fighting in emergencies. The hydrants can both treat the complete runway before the arrival of an aircraft arriving in an emergency situation, and also act in precision fire-fighting, either on one or more aircraft, or on their hot sections and other burning surfaces caused by the accident.

FIG. (2) illustrates the protection of two or more crossing runways and their corresponding flight lanes.

FIG. (3)*a* to *c* shows diagrammatically the three degrees of freedom of an extinguishing unit (hydrant), according to its three perpendicular projections. The dispensing of the extinguishing fluid may be carried out at the foot of the hydrant, or at the start of the supply pipe (in which case it could be single).

FIG. (4) graphically demonstrates the parallax error produced by standard surface radars. In the figure it is seen that as $MA=MP$; and $RA=RA'$, so that $OA \neq OA'$, and P does not coincide with A'. This distorts the x, y coordinates of the object when the runway has inclines.

FIG. (5) represents a plan and elevation of a flight lane in which the variation in slope of the runway axis is seen. Also the position of the telemetric sensors is shown (not to scale), forming successive rectangles or squares along the whole length of the flight lane, the successive rectangles thus being adapted both to the slopes and to the changes in gradient allowed by the OACI standard.

FIG. (6) is an illustration of the detection procedure while tracking an aircraft by means of infra-red sensors along the flight lane, thanks to the position of the colliding beams and the corresponding signals for their processing by computer.

FIG. (7) is similar to the previous one, although here one sees a dangerous situation in having two aircraft within the flight lane, which could collide. One can see also the rectangles formed by each set of four telemetric sensors-"infra-red sensored areas" (ISA).

FIG. (8) represents the tracking of an aircraft during the sequence of its entrance onto the runway.

FIG. (9) shows the sweep mode of the telemetric sensors along the flight lane. The sources in this case are motionless, three heat sources being represented, as well as the detection carried out by the four sensors from the four corners of the ISA in question, allowing the surface dimensions of each heat source to be accurately defined. The sweep mode is that used in emergencies.

FIG. (10) shows an airport layout in which can be seen both the flight lane (SPZ) and the taxiways equipped with detectors, guidance beacons and traffic lights. Inside the SPZ's neither detectors nor traffic lights are installed. However, at those points of the SPZ perimeter where taxiways impinge, the first detectors and traffic lights are installed, so that an aircraft is detected on leaving the runway. Full continuity in airport surveillance is thus achieved, since although an aircraft which exits from the area of the SPZ leaves behind the telemetric sensors tracking it, it will be immediately detected by the first taxiway detector on entering the corresponding section of taxiway. Thus, in both cases, where the aircraft is inside the SPZ and where it is on any taxiway, it is immediately displayed on the main panel located in the airport tower. Detectors, beacons and traffic lights have been shown in the drawing. Moreover, although automated hydrants could be sited in other zones, other than in the flight lanes, this does not seem justified in view of accident statistics.

FIG. (11) represents a view of the system equipment located in the tower; panel, console, computers and connections, as well as the position of the officer on watch in front of the controls. The panel is of large dimensions and almost vertical, its angle of inclination being adjustable, for ease of observation both by the operator and by other tower personnel. Since it is necessary that all the controllers can see the aforementioned panel, it will be located in the upper part of the tower's large window, and for this purpose a small building modification will have to be made locally in the roof of the tower, allowing the panel to be housed in front of the controllers, so that the latter can both observe the panel and see through the tower's window.

The RUSTEM system console controller directs taxiing and parking, and the remaining controllers direct flight operations on the runways and flight lanes.

The installation of the RUSTEM system does not involve alterations to the current consoles and installations, nor does it interfere with their operation or the work of the tower's flight controllers.

FIG. (12) represents the main panel located in the tower. Its dimensions are those which are appropriate and necessary to reflect the resolution and definition of sources of which the flight lane telemetric sensors are capable. The operation of both the flight lane computer and the computer dealing with taxiing is displayed on the panel. When there are emergencies the telemetric sensors go into sweep mode and the reference symbols which appear directly on the panel are emergency circles. In tracking mode, the aircraft reference is seen on the panel as well as a reference which changes according to the actual path of the aircraft.

FIG. (13) illustrates an airport flight lane in which an aircraft and a motor vehicle appear.

FIG. (14) represents an airport layout in which the surface radar and control tower are shown.

FIG. (15) shows in diagrammatic elevation, partly in section, an extinguishing unit (hydrant) of a fixed type with multiple pipes for use at certain points of a flight lane.

Having planned the system under the conditions described above, it is now appropriate to take stock of the current situation in airports in general, since the problem is substantially the same in all countries.

To start with the aspect of fire-fighting.

In all civil airports and air bases there is a fire station, equipped with tankers, prepared "ad hoc". This originates from the early days of aviation, as an extension of the method used by municipal fire brigades and has been evolved by trying to adapt to requirements.

Little by little, and despite the efforts made to improve it, its poor performance with regard to the special case of an aeronautical accident has become increasingly clear, as seen in practical cases.

Protests by pilots' associations and the frank pessimism of the aeronautical authorities devoted to this matter, confirm this situation in the various different countries.

For various reasons, as aircraft have been developed they have increased in volume and weight, and therefore in engine power and size of fuel tanks, and can achieve much longer flights.

This has caused airports to increase the capacity of the tankers in which water and special extinguishing agents are transported. This has already led to cases of enormous tankers, some of which have had to incorporate two engines, one in front and one behind. This would suggest that a limit has been reached in the method used.

Also, given the volume which has to be transported, there have been actual instances where the tankers have overturned, since, although smooth, there are unavoidable gradients in the airport terrain. There are thus some limitations and interactions between the load transported, speed of travel of the vehicle and stability.

Furthermore, if an accident occurs at the head of a runway, at the far end of the start of the runway, often muddy areas and other obstacles prevent or make difficult an approach close to the said accident.

On occasion, the aeroplane or colliding aircraft, are broken into sections which are dispersed, thus requiring the said tankers to be able to attend to all the fires simultaneously and involving an increase in the fleet of trucks necessary.

Moreover, the trucks cannot act on their own, but only when the airport tower so indicates. So that as in the majority of airports the surveillance function is deficient, as the tower first has to determine whether there is an emergency or not, a question which is often difficult and uncertain due to the lack of an instrument which can rapidly verify this, especially at night or in low visibilities.

All this causes a build-up of time which weighs heavily against a hypothetical fire and rescue operation, since first the tower has to determine whether or not there is an emergency, after that it has to notify the fire brigade and this has to be mobilized; then the journey has to be made from the fire station to the site of the accident, at times far away as in the case of the heads of runways. Once the fire brigade have arrived, they have to take charge of the disaster which has occurred different each time, which is complicated in the case of dispersed sections.

Thus, there is an excessive time lag which is inconsistent with the type of accident being considered. It is thus inevitable that performances have been low, losing human lives and increasing the damage to aircraft.

When in the past, aircraft were much smaller, less global inefficiency was observed with this procedure, but currently this is continually on the increase, since it is actually the method and procedure used which have to be changed globally, both in theory and in practice.

According to OACI publications extinction must be carried out in a period of five minutes, due to the fuel, its explosive capacity, and the toxic gases which may asphyxiate the passengers trapped in the accident.

Currently, the OACI specifies between two and three minutes for starting up fast fire trucks after the alarm has been given.

This clearly shows that between the five tragic minutes available and the two or three minutes for the mobilization of the high-speed trucks, there only remain two minutes for the work of extinction, thus emphasizing the necessity for using a different method, like the RUSTEM system whose automated hydrants enter into operation in a few seconds after the fire rescue button has been pressed by the tower.

In addition to the problems and limitations described, there are other problems which also act negatively on the efficiency of fire rescue operations, this time related to the rescue personnel themselves. These may be summarized as follows:

the fortunate rarity in the number of accidents paradoxically has a negative effect on the rescue personnel, because they become out of practice due to their enforced inactivity, leading to reduced performances when the critical time arrives of unavoidable emergencies.

Also, having arrived at the site of the accident, on the one hand they are tied to the fire tanker, and on the other the accident has managed to produce a number of fire sources. Thus, each accident being different, they have to improvise their action on the way, often leading to psychological blocks in the face of the urgency of the various sources to be extinguished and their dispersal.

The airport fireman, moreover, in contrast to his city counterpart, in all cases without the least exception, has to deal with an aircraft which is liable to explode at any moment in its emergency state. So that the fireman's own survival instinct militates against the work he carries out, acting in a situation of fear and insecurity which logically leads to low performances.

The truth is that it is irrational and preposterous to completely, systematically and without exception, require heroism as an everyday norm for work. So that if the technician does not carry out his own self-criticism, he will continue to maintain an error of principle and with it foreseeable low performances, as demonstrated in practical instances.

It is absurd to deal with saving the life of the pilot by placing the lives of several firemen at risk in the attempt. As human beings their lives are as important as that of the pilot and to be respected equally with all others.

If this is not agreed upon, the pilot may not be saved since fear will tend to paralyse the actions of the firemen, with predictable low performances.

Thus, no matter what the quality of the fire-tankers may be at a given moment, they have to be operated by firemen, whose actions are unpredictable.

DESCRIPTION OF THE PREFERRED EMBODIMENTS

Faced with this set of problems, both in the method employed and those related to the rescue personnel, the conceptual modification intrinsic to the present system is based on the following:

(a) the setting up of a fixed, buried installation on both sides of the runway, extending it to both ends beyond the thresholds.

(b) these two lines consist of hydrants, which in the position of rest are underground, covered by a steel cover flush with the surrounding area so that if an aircraft leaves the runway and runs over the said cover it will not damage the aircraft nor the hydrant hidden underneath.

(c) each hydrant incorporates two cannons whose elevations are generally at different angles and appropriate to every fire-fighting operation.

(d) each hydrant has a rotary base, so that it can rapidly assume any angle of azimuth, and therefore line up on the aiming position.

(e) the complete hydrant is capable of to-and-fro movement for covering the damaged area.

(f) the hydrant has a main trigger valve, continuously adjustable by servo-motor.

(g) the hydrant's range is such that it covers the whole width of the flight lane, i.e. each line of hydrants, being rotatory, covers at least two-thirds of the said width. Thus, the runway and its two adjacent areas are covered along the length of the runway and its two ends. For instrument runways, the OACI Standards establish the permitted runway widths as being between 45 and 60 meters, so that on these runways the width of the flight lane has to be not less than 300 meters.

(h) it happens that airport accidents occur statistically in 99% of the cases within the area defined by the flight lane, for which reason the automated hydrants are suitably located to cover any emergency in the aforesaid flight lane. The computer software does not improvise, but rationally covers all cases.

(i) as the pipes which supply the hydrants are always under load, and as the hydrants cover the whole width of the flight lane, the triggering of the hydrants is extremely rapid and they cover any emergency, whatever the topographical position of the accident and its separate focal points.

(j) the automatic action of the hydrants is computer-controlled, and as the buttons are pressed on the control console located in the tower, they act together in preparing the whole runway on the prior announcement of the arrival of an aircraft in an emergency, being accurately trained on the stopped aircraft, or its sections, whatever the topographical dispersal they may have. The fire-fighting takes place globally and simultaneously over all the heat sources present.

(k) the position of the aircraft or its sections, in x, y coordinates, is supplied by the telemetric surveillance of the present system, as will be explained later.

So, concentrating for a moment on the fire-fighting method described, the following advantages may be pointed out, amongst others:

1. The automated fire-fighting system requires only a few seconds to come into operation after the button is pressed in the airport tower, thus cutting out the excessive time lag which occurs with fire tankers.

2. As both the water and the extinguishing substances are supplied under pressure to the hydrant by means of underground pipes, no transport by truck is necessary, since now the extinguishing fluid is placed "in situ" via continuously full pipes.

3. Since the water and extinguishing agent storage tanks are also fixed, they can be as large as required, with reserves, whatever the size of the aircraft or the collision in question. The pump, the dispensers, valves, connections and auto-protection devices act in fast response, each line being fitted with the necessary service pressure regulation drum. The pressure is sufficient to guarantee the maximum range of the hydrants, the pump being automatically triggered and responding as soon as there is a slight reduction in the pressure of the regulating drum.

4. The computer which controls the hydrants selects these according to each accident, in accordance with the topographical position of the aircraft, or its sections, as well as according to the force and direction of the wind.

Furthermore, once the fire-fighting operation is initiated, this computer is updated with the possible variations in both the topographical and meteorological data relating to the accident, since new heat sources may have arisen and the wind data may have changed, so that the parameters of each hydrant are altered throughout the fire-fighting operation, the latter being self-adjusted automatically according to the possible variations in the mishap, as well as to those in the prevailing wind.

5. Each hydrant releases via its two cannons a large volume of extinguishing fluid, hitting the whole accident zone. If the aircraft in the emergency does not break up into sections, several hydrants will act together on the aircraft from different angles, hitting it rapidly with a large volume flow, leading to an extremely rapid extinction.

6. The hydrants do not suffer from psychological blocks, since they do not have to think about their actions in each accident, nor are they afraid of fire or explosions, instead when the fire brigade arrives on the scene of the accident, the fire sources will already be under control and since the lives of the rescue team will remain protected, the latter will complete the operation with high success rates, in favour of both the injured and uninjured.

7. The same can be said for the runway ends, since the system is the same.

8. Due to the automation and its great speed and coverage, in the majority of the accidents there will be a high rescue success rate, both in terms of people and in preventing more damage to the aircraft, which can be salvaged.

This completes the explanation of the principal fire-fighting concepts in the present RUSTEM system.

Now consider the aspect of airport surveillance.

The current general situation can be described as follows:

Although seemingly it might be imagined that there is nothing to enquire into regarding the matter in question, the negative secondary effects which the introduction of the ILS has had on civil airports and air bases should be pointed out, negative effects which were not taken into account when the use of the ILS was introduced and extended into all airports.

This very beneficial instrument was introduced to try to maintain air traffic running inspite of poor visibility conditions on an aircraft's approach to the airport.

The ILS (instrument landing system) is, in fact, a landing instrument.

The said instrument consists of an aerial which is located on the threshold of the runway, emitting signals which are picked up by an instrument on board, indicating whether the aircraft is to the right or left of the runway axis, as well as whether the aircraft in its approach is flying above or below the correct approach path. Hence, although the pilot cannot see the runway due to cloud, he carries out the landing on instruments, gradually altering his course until he is finally on the runway, landing in the touchdown zone.

The runways which have ILS are called instrument runways, which on the ground have to meet the strictest OACI standards regarding widths, slopes . . . etc., with their respective flight lanes being wider (a minimum of 300 meters).

Thus, it may easily be appreciated that in the past, when there was no ILS, pilots did not land unless they had complete visibility regarding the runway. The tower also had this same visibility with respect to the aircraft trying to land. Put simply, both visibilities, that of the pilot and that of the tower were one and the same visibility.

But, if suddenly the aircraft is given some electronic eyes with which the pilot can carry out the landing, without seeing the runway with his naked eye, there is a situation in which the operating minimums of this airport have been reduced, by which the aircraft is helped to land, but at the cost of leaving the tower blind if the tower has lost visibility over the complete airport environment.

Together with this there is a situation of general risk in all ground operations, which negative effect was not taken into account when the ILS was introduced and its installation extended into all civil airports and air bases.

In fact, although initially it would appear somewhat illogical, in reality the airport accident referred to previously at Madrid airport, in which two aircraft collided, was basically due to the existence of the ILS in the said airport, since although the ILS is a landing instrument, and in that accident there had been one aircraft landing and the other taxiing, both ground operations were being carried out in conditions of poor visibility, since the introduction of the ILS has lowered the operating minimums in all the world's airports. Neither aircraft saw the other, nor did the tower see either of the two by eye, nor did the tower see the collision, nor the place where both the colliding aircraft were to come to a halt in the flight lane. All the tower saw was fog and initially not knowing what had happened, lost time in calling the fire brigade who then had to look for the site of the accident, also in poor visibility.

On this occasion, the general risk mentioned above became a disaster, with a corresponding loss of human lives and damage to the aircraft. This airport accident is symptomatic of the risk situation which has been highlighted and which it is essential to correct, because from time to time it costs the lives of passengers and pilots.

Air safety embraces the whole environment, and it therefore also includes the ground-ground area.

The ILS comes under the air-ground heading, but an airport is an organic whole as with any object in reality, so that it is connected. Accordingly, if only one part is considered without taking into account the rest, as happened with the ILS (which was aimed exclusively at aiding landing), secondary effects may be, and, in fact, have been produced, such as that quoted of leaving airport towers blind.

Aircraft in an airport cannot move without the proper instructions from the control tower, but if the latter are blind with respect to incidents occurring on the runways, the tower personnel seem to be in a contradictory situation where they have to control and direct surface traffic and at the same time are left blind and without any instrument allowing them to view incidents in the airport. This contradiction from time to time costs people's lives and must be corrected.

That is to say, this is not an attempt to eliminate the ILS, since it is very beneficial, rather an attempt to provide the tower with a suitable instrument for carrying out telemetric surveillance in the airport, despite there being poor meteorological conditions, or that it is operating at night, as is usual.

In fact, the day has arrived for so-called surface radar, which instead of directing its beam into open space directs it towards the ground, sweeping the airport.

However, this equipment is not suitable, nor is it included in the present RUSTEM system. Here the telemetric method will be something else. There are various reasons for this:

In the first place, surface radar emits its pulses from one point, the aerial.

Secondly, the runway is not flat, but has gradients, even though limited and standardized.

In addition, it should be taken into account that radar does not measure distances, but the time difference between the transmission of the pulse and the reception of its echo bounced back by the object, although since the pulse and its echo consist of electromagnetic radiation their velocity (c) is known, and since the time difference between the transmission and reception is known, the corresponding distance is obtained. But in this process, if the object located on a runway is such that this runway is horizontal, or else has gradients, the result will be that although the straight distance between both objects and the aerial is the same, nevertheless their respective coordinates with respect to runway axes will be different in x, y. This parallax effect is shown in FIG. (4).

That is to say, standard surface radar falsifies the x, y coordinates of the object due to a parallax effect which appears when runways have gradients.

These gradients are smooth, but as the length of runways is relatively great, the result is that often there is a very significant difference in height (z) between one end of the runway and the other, so that, in fact, the radar falsifies the corresponding measurement of the x, y position of the objects.

These radars, which in themselves are not very economic due to their functional structure and the elements which they incorporate, would be even more expensive if an attempt were made to obtain the correct x, y coordinates, since in this case one would have to turn to a three-dimensional radar accompanied by a correcting computer Then the output signal from the (3D) radar receiver would have to be corrected with the computer, which in turn would have to contain the topographical data of the different points of the airport. This would have to take place in real time so that this type of equipment would be more complex and more expensive, and therefore not very advisable.

There is yet another problem which is that when speaking in general of airport or in-flight surveillance, the concept persists that this telemetric surveillance will be with respect to normal aircraft, when in fact in the case of an airport, not only do the movements and stoppages of normal aircraft have to be monitored, but also the telemetric system has to supply data on emergencies and fires in case of accidents. In addition, it is vital to obtain via telemetry, the actual form of the fire sources which appear. Only in this way will the aiming and automated action of the fire-fighting operation be efficient and accurate That is, the surveillance function and the fire-fighting function cannot be separated nor split off.

Thus, considering the case of a fuel lake in flames, the result of an accident, three (3) negative factors emerge with regard to surface radar:

(a) as said earlier, if the runway has gradients (and it always has some), the x, y position of the source is displaced, and as the hydrants constitute a fixed system in which each hydrant has its respective x, y coordinates with respect to the runway axes, the position of the source would be in error with respect to the hydrants, and their action would be incorrect, due to having carried out the telemetry by means of standard surface radar.

(b) but imagine a three-dimensional, computer-corrected radar, making the installation even more expensive. A second difficulty now appears, making the increased outlay practically useless. In actual fact, a burning fuel lake is seen from the radar aerial basically as a "wall" of flames and smoke. So that in any case the echo signal is going to give the position of this "wall", but is not going to give the surface dimensions of this burning lake, since the "wall" prevents the determination of the surface length of the lake, i.e. it is the straight section of the object which is used in the radar; in an airport the radar has an aerial raised at a point of proper height, and therefore the sweep carried out by the beam will come up against this "wall". Naturally if the surface extent of the source is not known, it will not be possible to operate the hydrants correctly.

(c) lastly, there is another reason, which is that flames generally return a distorted radar echo and the measurement is still not reliable.

All these reasons make the use of surface radar inadvisable, since in the event of using it, these problems would distort the necessary telemetry. Furthermore, radar will give the sections of the aircraft, but in an airport accident these sections are of less interest since the rupture factor already has no remedy in this case, of greater interest instead in the telemetry of emergencies is the position of the heat sources, which will sometimes coincide with the sec tins and at other times not. For example, an aircraft could have its undercarriage broken off in an accident, and this part could be detected by radar. But this part is of no interest as far as the hydrants are concerned, only the fire sources which are the sole item which must be eliminated as quickly as possible after the accident has occurred. Thus, if the telemetry gives mainly the metal sections and not the heat sources, this telemetry would be completely useless and detrimental in this instance, since it would oblige the hydrants to have to act on sections and not on sources, the hydrants being "thrown off track" by a bad choice of the telemetric method used.

Radar has been a great advance, but on every occasion the correct instrument has to be used which is consistent with the function demanding solution, without confusing the uses and functional possibilities of each instrument.

Moreover, although surface radar distorts x, y positions, it is used to give a screen display which is often sufficient for surveillance exclusively. But if an automated fire-fighting system is sought, those errors and difficulties which have been pointed out are disadvantageous, and another method of telemetry must be turned to, which naturally gives the correct x, y position of normal aircraft, but which also gives accurate data in cases of emergency, that is, with one and the same method, both functions must be brought about without duplicating the elements used.

Again, it is essential to understand that an airport is divided into two zones which are completely different in function:

(a) the flight lanes and the runways contained within them.

(b) the taxiways and parking areas.

In fact, when an aircraft is in operation, it does not, nor cannot have any intention in the airport other than to move in one of two directions:

from the parking area to the runway (going via the taxiways).

from the runway to the parking area (also going via the taxiways).

In a taxiway the aircraft travels very slowly and often in procession, where some aircraft follow others.

But in the flight lanes and runways the situation is completely different, since this is the ground-air or air-ground transition area. In a taxiway an aircraft can stop sharply if necessary, but this is completely impossible on the runways.

Thus, although the airport is an organic whole and its parts are interconnected, there are basic qualitative differences in these parts, and this differentiation therefore also has to be reflected appropriately in the telemetry system and its respective consequences and functional derivations.

For example, 99% of airport disasters occur in the flight lanes, so that it makes sense for the automated hydrants to be installed in the flight lanes, but not in other airport areas. That is, although they could of course be installed, it would not make sense comparing the function/cost relationship The same thing occurs with the analysis of surface radar, since there are many zones of little or no conflict in the airport, and for these surface radar surveillance gives a totally disproportionate function/cost relationship. Hence, this is another reason for the present RUSTEM system not using surface radar.

Also, as indicated by the OACI SMGC requirements, surface radar will not be regarded as the determining element. This is due, among other reasons, to the fact that although the tower can observe the said radar screen, the pilots in the taxiway cannot see this screen. It is specified that the pilots be guided "in situ", which requires detectors, guidance beacons and traffic lights at crossings, something which surface radar does not provide.

Because of guidance and emergencies, the RUSTEM system does not make use of surface radar.

As will be explained, two different methods will be used:

(1) Two parallel lines of infra-red sensors for the flight lanes. Each of these lines located on the longest sides of the rectangle formed by the flight lane. As for instrument runways, the flight lane has to be at least 300 meters wide, this would be the minimum distance at which both parallel lines of sensors are installed.

(2) Detectors and beacons for control of aircraft in the taxiways and parking areas. Reference is made here to the generic detector, the following different types of detector being able to be used: weight pickup, ultrasonic pickup, heat pickup, pickup of the metallic nature of the aircraft (magnetic or electrical fields) and so on, since it is essential in the RUSTEM system that such detectors are neutral throughout the airport, with the exception of the detectors which pick up the aircraft along its run, as the said detectors are only activated exclusively for aircraft, due to the interconnecting mechanism between each of the successive detectors.

In order that a detector can perform the pickup and send its signal to the computer it has to be activated by electric current. This activation will be such that it will occur as the aircraft itself moves. The activated detectors will "accompany" the aircraft's progress.

These detectors are installed in such a way that they allow the standard minimum distance between aircraft to be controlled. That is to say, if two aircraft on minimum specified distance, they are certain of not colliding.

(3) A simple system of traffic lights installed at the taxiway crossings. In this way the tower records for example aircraft movements on each of the internal taxiway routes in the airport, whether for aircraft going from the parking area to the operative flight lane, or for coming from the runway to the parking area, routes that are held in the memory of the computer which controls and guides each aircraft step by step.

In their turn, these traffic lights, which are seen by the pilots when taxiing, are connected to each other, with the detectors described above, and with the tower.

A general description of this aspect of the system is given below:

(1) Flight lane telemetric sensors.

The flight lane is another element which is very distinct from an aircraft parking area, since it is a place of movement, so that within the flight lane all aircraft have their engines running, and thus are sources of heat.

In the case of accident, fire sources are also heat sources. Ruptures are already without remedy and what has to be extinguished are fires. Hence, the common denominator of all incidents within a flight lane is heat.

Therefore the special ingredient of the RUSTEM system's telemetric method for flight lanes is the infrared telemetric sensors. These sensors are installed in rectangles, one sensor at each corner. So that each sensor in a line has its counterpart in the line opposite.

The flat area which is the flight lane, with no obstacle between the aircraft and the sensors, as well as having no obstacles between the aircraft and the hydrants, allows "sui generis" activation, difficult to repeat in other contexts, but which is totally serviceable in the case of flight lanes, the vast majority of airport accidents occur, either by sudden accident, or else through the arrival at the airport of an aircraft announcing its emergency condition.

The sensors run along the source-detector line, producing a signal which when duly converted from analogue to digital is able to be processed by computer.

As it occurs in two sensors at the same time, there are two lines of bearing whose intersection is calculated by the aforesaid computer, supplying in real time the x, y position of the source with great simplicity and accuracy In turn, the rectangles or squares formed by four sensors, are such that they are successively adjusted to the whole length of the flight lane and its corresponding topography, so that each set of four sensors form (with small error) a plane. Thus the three-dimensional problem substantially disappears and the telemetry is exclusively surface telemetry in x, y. This is taking into account the fact that we are not no considering aircraft in flight, but on the ground, i.e. in their landing or take-off runs and in their taxiing movements within the confines of the flight lane. The latter not only contains the runway, but also covers the part corresponding to fast exits etc, i.e. the paved junctions connecting with the runway.

The telemetric sensors of the present system can operate in two different modes:

(a) Tracking.

(b) Sweep.

In the first case this is the normal functional mode tracking the paths of normal aircraft in their operations within the flight lane. It is naturally assumed that there is to be only one single aircraft within the perimeter of the flight lane, since although this is often forgotten after airport construction, the flight lane is a standard obstacle free zone. It does not make the least sense to put great effort at the time into planning and constructing an airport, strictly observing the standard of obstacle free zones, then afterwards, once the airport was entered into operation, aircraft are placed within the flight lane, as happens many times with threshold waiting zones.

A waiting aircraft has to be outside the flight lane, not inside it, since an aircraft inside the flight lane whilst there is another one operating on it, represents a sdangerous obstacle for the aircraft which is not waiting, as it is loaded with passengers and above all fuel, so that inside the perimeter of the flight lane there must be only one aircraft if the intention is to meet the OACI standard for obstacle-free zones, which is absolutely necessary for air safety.

A chimney or an aircraft may be such an obstacle, if they are situated where they ought not to be.

So flight lane sensors will now detect if there are one or more aircraft in it, since the telemetry will of course be tracking, and this will be displayed on the main RUSTEM panel located in the tower.

When there is an emergency, the sensors leave tracking mode and change to sweep mode by the pressing of an emergency button on the control console also located in the tower.

The sweep takes place from the four corners formed by four sensors, so that the surface form of the heat sources is obtained. (Surface radar only transmits from a single point, the aerial).

At the computer level this gives rise to a circle being displayed, inside which the source is recorded. If there is more than one source, they would have corresponding emergency circles.

This data, together with the wind force and direction data, is passed on to the computer which controls the hydrants, which computes the selection of hydrants and the parameters of each of those selected, thus initiating the fire-fighting operation.

That is to say, the sensors receive the emergency data and the hydrants are triggered by the computer system, all this work being done very rapidly, considering the elements involved, with the functions of telemetric surveillance and automated fire-fighting being integrated.

By pressing a single button on the console located in the tower, the process described is set off, which is measured in seconds, the response time being very fast, as demanded by the extinction operations in question.

(2) The detectors located in the taxiways are in their turn connected to the computer controlling all the airport taxiing.

This is a different environment from that of the flight lanes. Here the aircraft travel more slowly, following in procession. What is of interest now is maintaining the minimum distance between aircraft. That is, the position of the aircraft has to be monitored within a taxiway, and above all the maintenance of the said distance has to be controlled for safety purposes.

In order to do this the detectors are sited in the taxiways and the guidance beacons also guarantee this minimum distance. Where there are crossings traffic lights are located at their "entrances".

In other words, this involves only having one aircraft between each two taxiing detectors, being activated by the aircraft's own progress, and not detecting other objects.

This is a similar situation to the technique used in the airways while aircraft are in flight, maintaining the distances between them. In the present case this situation is controlled on the ground by means of one of the said detectors, the aircraft being able to be quite close to each other, but not too close, since although they are travelling slowly they still have some velocity.

With this type of detector the passage of the aircraft in front of the detector as well as its direction of travel are detected.

For each new detector which picks up the aircraft's progress, the computer lights another axial beacon for this aircraft, every aircraft on the taxiway having a fixed number of axial beacons lit in front of the nose of the aircraft according to the specific route of each aircraft.

The sequence of successive activation of the detectors is produced by means of the interconnecting mechanism between adjacent detectors. An activated detector on picking up the aircraft not only sends its signal to the computer, but also activates the next detector and deactivates the previous one.

Furthermore, if there is an aircraft in a section of taxiway, which is accounted for, and another aircraft enters this same section, the record shows two aircraft in this section and another signal appears on the main panel in this section; the second signal being arranged to flash and a small alarm sounds on the console at the same time. That is to say, an infraction has been detected and the tower personnel slow down the offending aircraft, thus avoiding damage. That is, the offending aircraft would be at a lesser distance than the standard minimum distance between aircraft, causing risk and possible collision. In such cases, the appropriate computer causes the axial beacons of the offending aircraft to flash.

(3) The airport traffic lights of the present system are different from those in towns, although the three lights: green, amber, red, are also used.

The traffic light has two faces with the three lights on both its faces, like the faces of a coin. Although all of this is adapted to the airport context.

In actual fact, what at one moment is given as the valid direction on a taxiway, may become the prohibited direction in another moment. For example, the airport of Las Palmas de Gran Canaria is situated in a region of the world subject to trade winds which change direction twice a year. Thus the operative head of the runway changes according to the season of the year in question. Hence, on altering the runway head the internal routes for taxiing are changed accordingly.

On the control console there is a diagram of the runways and a button panel with which the internal taxiing routes are recorded at each moment: start and end point.

If a second aircraft tries to enter a taxiway crossing occupied at that time by a preceding aircraft, the pilot of the second aircraft meets with an amber light which tells him that the route he is taking on the taxiway is correct, but the amber light indicates to him that there is an aircraft in front on this section of taxiway, and therefore the second aircraft has to wait until the amber light disappears, since only then will he be able to enter this section of road. In addition, the fixed number of axial beacons flash on and off.

That is to say, not only is the taxiing control function on the part of the tower involved, as happens with surface radar, but also the pilots have clear instructions "in situ" corresponding to this control. The pilots can see the traffic lights activated "in situ", but cannot view the surface radar screen, since obviously this will only be seen by the tower personnel. For these reasons also surface radar is not suitable and is not used in the RUSTEM system.

It is a question of synchronizing the tower and the taxiing aircraft, with the dual function of instructing the pilots "in situ" and at the same time controlling taxiing from the tower, both in marking out the internal taxiing routes and in detecting infractions, thus achieving control over the minimum distance between aircraft, which is what is important for safety purposes, having an objective measurement available on all occasions.

It is as important that the tower has a display available of what is happening on the runways as it is that the pilots have the data available "in situ".

The signals corresponding to aircraft may be seen on a surface radar screen, but the pilots cannot see this "in situ", nor does it help them at all in maintaining the standard distance between aircraft.

On the main RUSTEM system panel, one can see both the aircraft in the flight lanes (due to the signals sent back by the telemetric sensors), as well as all the aircraft on the taxiways (due to the continuous detectors). Thus, radio should only be used where essential.

To summarize, where there is an ILS in operation, the operating minimums are lowered and telemetric surveillance is therefore essential. Moreover, there must be monitoring and certainty that there is only one aircraft inside the flight lane, since the obstacle-free zone standard must be met which basically affects the whole of the flight lane. Similarly, the minimum distance between aircraft in the taxiing sequence must be monitored, while at the same time all the aircraft are being guided along their taxiway.

Furthermore, telemetric surveillance must be functionally integrated with automated fire-fighting in the flight lanes.

It emerges from all this that, for the reasons explained, surface radar is not the appropriate instrument, but rather the installation of telemetric sensors, detectors, axial beacons and traffic lights, as in the case of the described RUSTEM system, which to distinguish it from other airport systems has been called this for short, standing for "runway security and taxiway escort system", in which three functions are considered: surveillance, guidance and fire-fighting. With this the tower actually recovers its functions. One could then have smaller, faster and cheaper fire tankers for taking care of possible fires in other airport zones, but used as an auxiliary measure with respect to the automated hydrant installation, as a much more powerful and faster system, as demanded by the aeronautical accident, this being able to take care of any type of emergency in the flight lanes which is where airport accidents tend to occur.

This also reduces the general installation costs and those of maintenance, simultaneously achieving a high degree of reliability, speed, and simple and secure operation on the part of the tower personnel, who would thus have a working tool which they can use whatever the meteorological conditions, night-time situation or traffic density, the RUSTEM system being adaptable to any airport.

Figure 13:
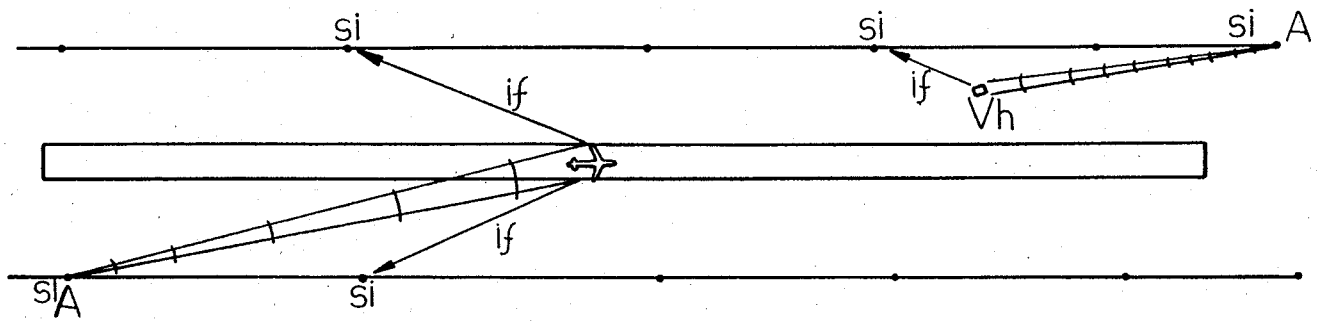
Figure 14:
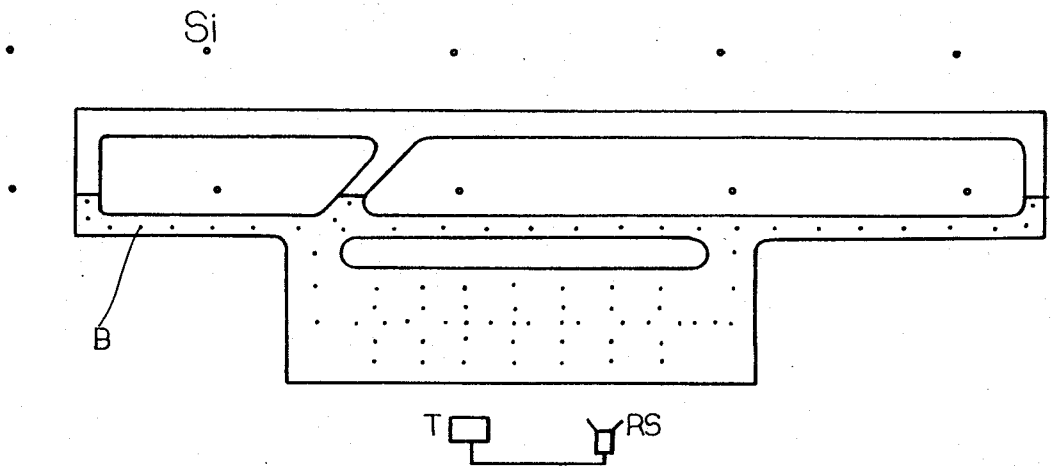

Lastly, as shown in FIGS. 13 and 14, especially in FIG. 13, along the sides of the flight lane will be arranged a series of standard infra-red sensors, Si, as well as some special infra-red sensors, SiA, with an additional element for transmitting and receiving electromagnetic or ultrasonic pulses. The infra-red rays, if, which leave the aircraft are picked up by both types of infra-red sensors as the aircraft passes in front of them, and the data thus obtained is sent to the central computer of the installation fitted in the control tower, T (FIG. 14). The two types of infra-red detectors can pick up not only the infra-red rays originating from the aircraft, but also the infra-red rays, if, originating from any vehicle, vh, which is travelling along the flight lane.

Also, as can be seen in FIG. 14, the control tower, T, is linked in with the airport's surface radar, RS, FIG. 14 also illustrating the normal infra-red sensors, Si, and the taxiing and guidance detectors and beacons, D-B.

As a result of the present invention, the automatic surveillance, guidance and fire-fighting installation for airport aircraft covers the whole spectrum of safety in an airport and is thus in the optimum position to meet the different safety emergencies which may arise in airport traffic.

Figure 15:
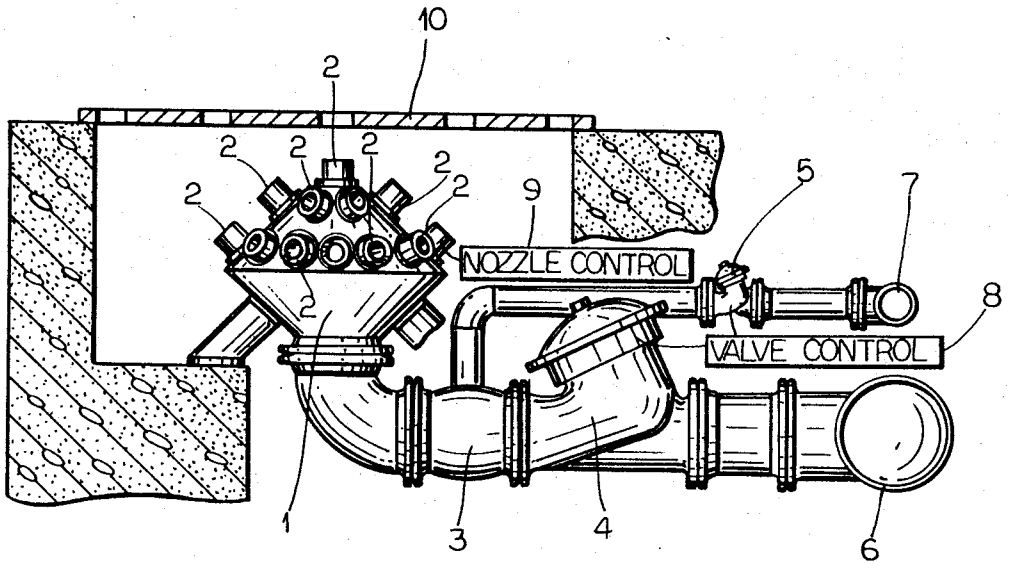

In FIG. 15 a fixed multiple pipe hydrant is represented. As can be observed, with 1 the member properly speaking of the hydrant is designated, which acts as support for assembly of the nozzles for ejecting extinguishing fluid. Although in this case a hydrant hasd been represented for 19 nozzles, it is obvious that its shape can have an infinity of variants, in relation with the work parameters and with the number of nozzles to be installed. As can be observed, the different nozzles are assembled throughout its active periphery which is what enables ejection of the extinguishing fluid. The nozzles (2) are in turn comprised by a member with one of more openings, as may be needed, for ejecting the extinguishing fluid.

Said nozzles (2) always incorporate a closure system which allows opening of those which may be necessary by means of a signal. (3) designates the dispenser of extinguishing agent incorporated in the hydrant; number (4) designates the valve for the water; with (5) the control valve for extinguishing agent is represented; with (6) the water conduction piping; with (7) the extinguishing agent conduction piping; with (8) the control box for actuating the water and extinguishing agent valves; with (9) the control box for actuating the nozzles, and with (10) the cover with openings which allow passage of the extinguishing fluid. The cover (10) has a mechanical resistance sufficient to allow the passage of the usual vehicles or aircraft on top of them.

I claim:

1. An automatic installation for surveillance, guidance and fire-fighting in airports, which controls the position of different aircraft in flight lanes, taxiways and parking areas and, in the event of accident, carries out automatic extinction of fires in the flight lanes and at their ends, comprising:

a series of sensors arranged in two parallel rows along flight lanes and their ends beyond runway thresholds thereof up to an established distance, the sensors being of infra-red telematic type for picking up the path of any mobile vehicles, whether aircraft or automobile, in the flight lanes;

position detectors in taxiways and parking areas for discriminately detecting the position of the vehicles depending on their position and their movement and the direction of the latter, and to automate their guidance by means of beacons along the axis or at the edge of runways respectively of the flight lanes, lit up by computer;

traffic lights connected to the beacons and located at established distances in any crossings of the taxiways;

anemometers located in the flight lanes;

fixed type hydrants with multiple pipes, neither mobile nor capable of being lifted up from the ground, remotely controlled by computer with fast activation, to carry out the extinction of possible fires located in the flight lanes and in their ends in case of accident;

two supply stations or installations to the hydrants, one at each side of the lane divided into units; and each hydrant incorporating a dispenser of water/-foam mixture; and a computer in which all the information received by the sensors, along with the wind force and direction data proceeding from a computer to command the hydrants is supplied to these hydrants, the hydrants globally and simultaneously ejecting extinguishing liquid against the heat sources, following the instructions of the said computer for the hydrants, thus integrating the functions of telemetric surveillance and automated firefighting, this being achieved at high speed, on the hydrants entering into operation in a few seconds after the tower pushes the fire-fighting button.

2. An installation in accordance with claim 1, wherein each one of the sensors incorporates its own computerized system, which processes all the information referring to the heat sources of whatever type.

3. An installation in accordance with claim 1, wherein the sensors of the flight lanes are connected to one another, determining the position of the aircraft, whether at a halt or moving, located within such lanes, in an instantaneous and continuous manner, supplying the corresponding computer with data as to the heat sources which are represented in actual time in the control tower panel.

4. An installation in accordance with claim 1, wherein the separation between each two consecutive flight lane sensors of each row is sufficiently small for the distance between them to be approximately equal to its horizontal projection, and in that each four sensors form a rectangle of detection which is achieved by the sweep of the different sensors, the outputs of digital signals processed in the sensors being united through the said computer, and the sensors being located along the flight lane's own particular topography, to allow surface telemetry.

5. An installation in accordance with claim 1, wherein the position detectors in the taxiways and parking areas are all neutralized except those which pick up exclusively aircraft in their respective continuous movement sequences, between an initial point and another final point, in which the detectors can be weight sensing, pickup by ultrasonic transmission and reception, transmission and reception of light, infra-red, laser, or else of the electrical or magnetic field wherein, during pickup of the aircraft, the detectors send the corresponding signal to the computer and the latter, on each aircraft taxiing, deactivates the previous detector and activates the following detector, the latter remaining ready to pick p the aircraft when it passes in front of it, which signals are transmitted to the computer triggering the latter into lighting and extinguishing the guidance beacons.

6. An installation in accordance with claim 1, wherein the mentioned taxiing and parking detectors are also designed to operate jointly, but discriminately and picking up both aircraft and other vehicles, without confusing them, to send the corresponding signals, already discriminated, toward the center of the control system, and in that the guidance beacons maintain the minimum distance between aircraft, and in that the computer has means for transmitting orders for flashing the guidance beacons on and off intermittently of one of the aircraft which enter a crossing and lighting up the traffic light at red of the crossing corresponding to said aircraft, as well as means for cancelling the red traffic light, the halted aircraft then being able to continue, once the other aircraft has passed the crossing.

7. An installation in accordance with claim 1, wherein the control continuity of the aircraft is achieved through the lens sensors and the taxiing detectors.

8. An installation in accordance with claim 1, wherein the traffic lights are situated only at the crossings of the taxiways, in a position related to that of the detectors and connected to them, to the guidance beacons and to the control console, the traffic lights being activated only in the event of opposing routes in aircraft taxiing.

9. An installation in accordance with claim 8, wherein in the event an aircraft had to return to the parking area, the controller would cancel the route which had been allocated to the said aircraft and would input on the keyboard the new initial and final point for said aircraft, which is guided back on its return.

10. An installation in accordance with claim 1, wherein the information relating to said wind force and direction generated in the anemometers, as an integral part of the system, is dealt with by the computer for the hydrants which, on the basis of the same, effects calculations for aiming the different hydrants in emergency situations.

11. An installation in accordance with claim 10, wherein each one of the hydrants comprises by fixed multiple pipes, without rotation or lifting movements, geometrically arranged to eject the fluid in the automatically selected direction.

12. An installation in accordance with claim 10, wherein the arrangement of the hydrants in the crossings of the different flight lanes is such that the distance from the most distant point from them is minimal.

13. An installation in accordance with claim 1, wherein each one of the hydrants arranged in two or more rows is independent of the rest, and is solely controlled by the corresponding computer.

14. An installation in accordance with claim 13, wherein each one of the fixed multiple pipe hydrants comprises a series of nozzles assembled in the entire active periphery of the hydrant, comprised by a member with one or more openings for ejecting the extinguishing fluid, the whole being covered by a perforated steel cover which does not project beyond the ground.

15. An installation in accordance with claim 1, wherein the computer for the hydrant solely intervenes in an emergency situation, being inactive in normal situations.

16. An installation in accordance with claim 1, wherein the hydrants spray the complete runways when there is an emergency situation, or operate accurately when the aircraft is at a halt.

17. An installation in accordance with claim 1, wherein it includes in the control tower two panels, a general one with the representation and identification of the aircraft in the flight lanes and in the taxiways and parking areas, and another exclusively for the flight lanes.

18. An installation in accordance with claim 17, wherein the normal aircraft representation and emergency situation one are reflected in a different form on the screen, for alerting the computer together with sounding of alarm.

19. An installation in accordance with claim 1, wherein, given the diversification of the extinguishing liquid deposits, the installation is acceptable to any airport configuration.

20. An installation in accordance with claim 1, wherein some of the flight lane sensors can, besides picking up infra-red, incorporate a transmitter and detector of electromagnetic pulses, or else an ultrasonic active element, destined to detect any mobile object within the flight lane; the infra-red sensors pickup the aircraft located in the flight lane and the vehicles entering it, in that it is provided with an interface which processes the signals originating from a surface radar and of introducing such signal into the computer which controls the surveillance; the taxiing detectors are simultaneously activated throughout, and the pickup of aircraft and other objects is carried out simultaneously, in this case the discrimination of the different objects being effected by the different signals received and sent to the computer identifying them by their corresponding software and achieving a logical sequence in the guidance of each aircraft in the zone of movement and parking; the discharge of the water and extinguishing agents contained in the different deposits and pipes is carried out by means of the pressure of a compressed gas connected by regulating valves to the water and extinguishing agent reservoirs.

21. An installation in accordance with claim 1, wherein the infra-red sensors operate in a normal scanning way, providing the computer with information as to the movement of the aircraft or else in an emergency mode, wherein the sensors provide information as to position and surface dimension of each heat source in the flight lane.

22. An installation in accordance with claim 21, wherein the multiple fixed pipe hydrants direct the extinguishing fluid to the whole area of said flight lane, or else to selected areas.

23. An installation in accordance with claim 1, wherein the anemometers, in virtue of the strong wind direction, send data to the computer which, jointly with the data sent by the flight lane sensors, calculate which hydrants are to operate, as well as the pipes of the same which have to open and control the valves of a dispenser for the type of foam/water mix having to be ejected.

* * * * *